United States Patent [19]

Talbot

[11] 4,060,970

[45] Dec. 6, 1977

[54] SIMULATED SPUN-LIKE BULKED YARN

[75] Inventor: James Richard Talbot, Charlotte, N.C.

[73] Assignee: Fiber Industries Inc., Charlotte, N.C.

[21] Appl. No.: 674,350

[22] Filed: Apr. 7, 1976

[51] Int. Cl.[2] ..... D02G 3/34

[52] U.S. Cl. ..... 57/140 R; 57/140 J

[58] Field of Search ..... 57/140 R, 140 J, 157 F

[56] References Cited

U.S. PATENT DOCUMENTS

| | | | |
|---|---|---|---|
| 3,091,912 | 6/1963 | Stoddard et al. | 57/140 R |
| 3,296,785 | 1/1967 | Hardy | 57/140 R |
| 3,425,893 | 2/1969 | Sims | 57/140 J |
| 3,529,323 | 9/1970 | Hugbey | 57/140 R X |
| 3,785,135 | 1/1974 | Seem et al. | 57/140 R X |
| 3,785,136 | 1/1974 | Tecce et al. | 57/140 R X |

*Primary Examiner*—Jerry W. Myracle
*Assistant Examiner*—Charles Gorenstein
*Attorney, Agent, or Firm*—Herbert M. Adrian, Jr.

[57] ABSTRACT

A method for producing a spun-like yarn simulating a staple yarn is described wherein continuous filament yarn is produced which has characteristics similar to a staple spun yarn. The unusual continuous filament yarn produced is made by a texturing process which involves the crimping of a continuous synthetic yarn followed by overfeeding to an air bulking means and thence to heat setting means. The preferred method utilizes false twist texturing of synthetic filaments such as polyester, nylon, cellulose acetate or cellulose triacetate and mixtures thereof with an air bulking jet interposed to act on the false twist textured yarn while it has a high residual torque and subsequently decaying said torque.

11 Claims, 3 Drawing Figures

SIMULATED SPUN-LIKE BULKED YARN

BACKGROUND OF THE INVENTION

For many years, the textile industry has sought ways for producing yarns from continuous filaments such that the yarns have the characteristics of a spun yarn comprised of staple. Prior to the advent of synthetic filaments, all yarns were produced from staple products. Synthetic filaments, however, are made as continuous filaments and, in order to provide the desirable effects of staple products, a vast proportion of synthetic filament production is cut into staple length fibers. Such fibers are then twisted into yarns, called spun yarns.

Spun yarns have a particularly desirable characteristic of being somewhat fuzzy or hairy along their length giving them the desirable attributes of softness and cover and, when produced into fabrics, the ability to produce low density, porous, permeable and comfortable materials. Continuous filament yarns also have many desirable attributes but they also have their limitations, particularly in respect to bulk, cover and confort factors. Nevertheless, continuous filament yarns have replaced spun yarns in many end uses. Of course, it is obvious that if a continuous filament yarn could be made into a spun-like yarn, the otherwise expensive steps of cutting continuous fibers into staple followed by carding, coning and twisting into roving, followed by drafting and twisting further into yarns could be eliminated.

Many attempts have been made to accomplish this feat but various limitations in the resulting product have kept such continuous filament yarns from being complete replacements for spun yarns. In particular, previous methods, such as the very popular false twist texturing method for crimping continuous filament yarns to produce bulk and cover, have had their limitation in that the yarns always end up having a rather synthetic feel and look. This is probably due to the lack of the fuzzy and hairy projections which are present in spun yarns.

It is an object of the present invention to produce a simulated spun-like yarn which is made from continuous filaments and does not have the disadvantages of the prior art.

It is another object of the present invention to produce a spun-like yarn which has high knitting and weaving efficiencies.

It is yet another object of the present invention to provide a spun-like yarn which has substantially different characteristics from previous bulked yarns while at the same time having the desirable characteristics of staple spun yarn.

These and other objects of the present invention will become apparent to those skilled in the art from a reading of the present description.

THE INVENTION

In accordance with the invention, there is provided a process for producing continuous filament spun-like yarn comprising false twist texturing a synthetic continuous filament yarn to produce a torque lively yarn, overfeeding said textured yarn to a high velocity gaseous jet to convolute individual filaments in the yarn to form a plurality of torque induced kinks, preferably heat treating said yarn to reduce the torque and subsequently winding said yarn onto a package.

The continuous filament spun-like yarn of the present invention comprises a multifilament synthetic yarn wherein individual filaments are longitudinally in a helical configuration with periodic reversals of extended helix direction along their length, said individual filaments additionally having torque induced kinks and twisted loops in random distribution along the length of said yarn, said yarn being held together as an integral bundle by the intermingling of the respective individual filaments. The yarns of the present invention can be produced from any continuous synthetic filament including but not limited to polyester, nylon, cellulose acetates, cellulose triacetates, acrylics, modacrylics and mixtures thereof.

A particular advantage of the present invention is that known and extensively used texturing equipment can be modified in accordance with the present invention to produce the present yarn. Consequently, large expenditures of capital are not required. This is particularly advantageous because it gives flexibility to a yarn throwster to produce a variety of different yarns which are very distinct, one from the other.

DETAILS OF THE INVENTION

The invention will be more fully described by reference to the drawings in which.

Figure 1:
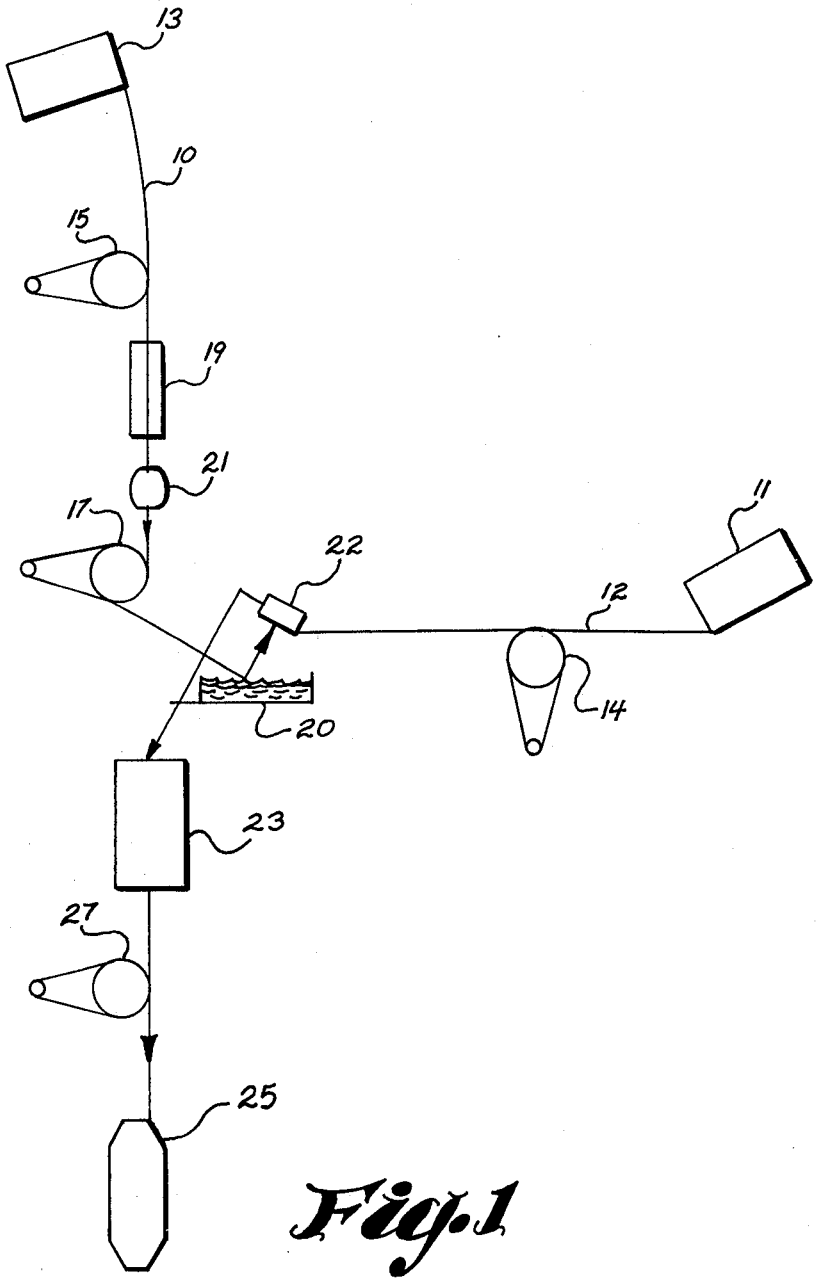
FIG. 1 is a schematic view of the process of the present invention.

Referring more particularly to FIG. 1, a typical draw texturing schematic is shown wherein yarn 10 is withdrawn from package 13, passed over feed roll 15 and across heat setting zone 19 through twisting means 21. Twisting means 21 rotates yarn 10 to a highly twisted state wherein the twist backs onto heating means 19 wherein the twist is set. As the yarn is drawn through the twisting means 21 by draw rolls 17, it is untwisted. The untwisted yarn is then fed through bulking means 22 in a substantial overfeed which is determined by the different speeds between draw rolls 17 and takeup rolls 27. Preferably, prior to reaching takeup roll 27, the yarn is heat set by heat means 23. As the yarn passes from takeup rolls 27, it is taken up on package 25 in the conventional manner.

The noted schematic is typical of that utilized in draw texturing, although the present process can be utilized without a simultaneous drawing and texturing step. In draw texturing, a differential speed is set between feed roll 15 and draw roll 17 such that draw roll 17 operates at a higher speed than feed roll 15. The differences in the speeds determines the draw ratio. When fully drawn yarn is utilized, feed roll 15 and draw roll 17 may be operated at about the same peripheral or linear speed. Slight variation in peripheral speed may be desirable depending upon tensions utilized in the twisting area.

Heating means 19 is preferably a heated plate but could be a hot pin, heated roll, steam chamber, hot air oven or the like heating means which are capable of heating the yarn above the second order transition temperature and preferably to the desired heat setting temperature of the yarn such as 180° to 250° centigrade for polyester. The critical temperature in the process is the temperature that the yarn reaches, which temperature is referred to herein. The heating means per se can, and often is, at a temperature greatly in excess of the temperature which the yarn actually attains. Such heater temperatures can well be in excess of the yarn melting temperature, with the speed of the yarn being sufficiently high to prevent melting of the yarn.

Twisting means 21 can be any of the numerous known twisting devices which are capable of inserting the desired degree of twist into the yarn at the linear speed at which the present invention is utilized. Such twisting devices are capable of putting in a wide range of twist levels per inch up to as much as 200 twists per inch (t.p.i.). The present process, however, preferably utilizes a lower t.p.i. than would be desirable in conventional false twist textured yarn. Consequently, twisting means, which are capable of inserting the preferred twist level of 5 to 60 t.p.i., and more preferably 15 to 45 t.p.i., can be utilized.

Because of the generally lower twist level used, spindle twisters can be utilized even at fairly high texturing speeds, because with the lower t.p.i. inserted, the speed of yarn can be greatly increased over conventional process speeds. The desired yarn processing speed thus becomes limited, not by the speed of the twister, but rather by the capability of the bulking jets which are utilized. Although friction twisters can be conveniently utilized, spindle twisting means are often preferred because a lower twist per inch is more readily controlled with spindles. Friction twisting means, however, are normally capable of much higher linear speeds than spindle twisters for the same inserted twist.

The amount of twist put into the yarn is dependent on the yarn denier and the desired amount of subsequently inserted projecting kinks. Thus, for low denier, higher twist levels are normally used while for higher deniers, lower twist levels are often desirable. The most desirable twist level ranges for various yarns can be expressed by the equation:

$$(400 \pm 340/\sqrt{\text{denier}}) = \text{twists per inch}$$

wherein denier is that as measured at the draw roll.

The most preferred range is in accordance with the equation:

$$(400 \pm 150/\sqrt{\text{denier}}) = \text{twists per inch}$$

These equations represent a preferred twist level range of about 5 to 57 t.p.i. and more preferably about 19 to 42 t.p.i. for 170 denier.

The feeder yarn of the present invention can be either fully drawn yarn, partially drawn yarn or undrawn yarn. When fully drawn yarn is utilized, no drawing step is effected during the twist insertion and heat setting of the yarn. With partially drawn and undrawn yarn, a draw ratio is applied during the twisting and heat setting step of the yarn. The draw ratio utilized is dependent upon the break elongation of the feeder yarn. With undrawn yarn, the draw ratio effected would be equivalent to a draw ratio which would be utilized in a normal draw texturing operation, i.e., 2 to 6 times the fed yarn length.

It is often preferred to use a partially drawn or partially orientated yarn. Such yarns are produced by the high speed takeup of yarn during spinning to thereby develop a birefringence in the yarn. Such partially orientated yarns are most desirably used with polyester yarns wherein a birefringence is developed in the yarn of at least 0.020 up to something less than fully drawn or about 0.100. At the high speed takeup which produces such birefringence, the yarn develops less crystallinity than conventionally drawn yarns such that the crystallinity is normally less than 40 percent and most usually 10 to 30 percent, although the crystallinity can be as low as 0 percent. The yarn, however, does have residual elongations such that further drawing can be effected to reduce the break elongation from an original 50 to 200 percent to a break elongation after draw texturing of about 20 or less percent.

The measurement of birefringence is made by the retardation technique described in "Fibers from Synthetic Polymers" by R. Hill (Elsevier Publishing Co., New York, 1953) at pages 266 to 268. Using a polarizing microscope with rotatable stage together with a Berek compensator or cap analyzer quartz wedge.

Crystallinity may be measured by simple density measurements, for example by the method described in "Physical Methods of Investigating Textiles" by R. Murdith and J. W. S. Hearle (Textile Book Publishers, Inc., 1959) at pages 174 through 176. Other methods are also known for completing these measurements such as when non-round cross sections are used, a dye is present in the fiber or various other additives are present which might effect the measurement stated above.

The present feed yarns can be prepared from polyester, such as polyethylene terephthalate, and particularly those polyesters and and copolyesters which contain at least 80 percent polyethylene terephthalate. Additionally, nylon such as nylon 6, which is polycaprolactam; nylon 6,6, which is polyhexamethylene adipamide; nylon 6 T, which is polyhexamethylene terethalamide; nylon 6,12 and the like, as well as cellulose acetates, cellulose triacetates, acrylics, modacrylics, polyvinylidine chloride and the like.

With polymers such as polyester and nylon, the feed yarn is preferably prepared from polymers having an intrinsic viscosity in the range of about 0.45 to 1.0 and more preferably in the range of about 0.55 to 0.80. The intrinsic viscosity is determined by the equation:

$$(LM/C \rightarrow O) \times (NR/C)$$

wherein NR is the relative viscosity. Relative viscosity is determined by dividing the viscosity of an 8 percent solution of polymer in orthochlorophenol solvent by the viscosity of the solvent as measured at 25 degrees centigrade. The polymer concentration in the noted formula is expressed as "C" in grams per 100 milliliters.

The synthetic polymers utilized herein may also contain various additives which effect the characteristics of the polymer and resulting fibers such as to improve dyeability, nonflammability, static electrical properties, reduce luster and the like. Such various modifiers, as are conventionally used in such yarns, include chemical and physical modifiers which effect the chemical and physical properties of the fiber. Copolymers of polyethylene terephthalate such as with cationic or anionic dye modifiers and/or with other reactive modifiers such as isophthalic acid, sulfoisophthalic acid, propylene glycol, butylene glycol and the like reactive monomers can be used. Yarns meeting the specific requirements of the present process may additionally or alternatively contain minor amounts of materials used in conventional yarns such as dyesite modifiers, delustrants, polymer modifiers and the like up to 20 percent, but most preferably not more than about 5 percent by weight.

The denier of the yarn as measured at draw roll 17 is preferably in the range of 20 to 1,000, more preferably 50 to 500, and most preferably 70 to 400 total denier. The denier per filament is within the range of 1 to 10.

The cross section of the yarn can have a pronounced effect on the resulting product. Normally, round cross section can be used with good results. However, for the certain desirable effects, a nonround cross section, such as a multilobal cross section, is particularly desirable. Such multilobal cross sections are well known in the art and comprise yarns with regularly or irregularly spaced and shaped lobes. The number of lobes can vary from 3 to 12 or more with 6 to 8 lobes being the most preferred. It has been found that the noted multilobal yarns tend to process more readily into the yarns of the present invention with more efficiency.

The yarn coming from the twister 21 is untwisted as it is passed through the twister and then passed to draw roll 17. Between draw roll 17 and takeup roll 27 false twisted, untwisted, torque-lively yarn is passed through texturing jet 22 in a substantial overfeed. The overfeed is in the range of at least 15 percent up to 70 percent, more preferably 20 to 40 percent, the amount being sufficient to permit retraction of the yarn in jet 22 as it is acted on by the turbulent fluid forces within said jet. The degree of overfeed will control the amount of kinks set into the yarn with greater overfeed producing greater numbers of kinks.

Prior to the yarn passing through the jet, it is preferred to moisten the yarn with water. The moisture improves the efficiency of the jet. Moisture can be added to the yarn in numberous ways such as by means of water bath 20, kiss rolls such as are used to apply finishes, various other known finish applicators, mistors, water jets and the like.

Numerous suitable texturing jets are known in the art, such as those described in U.S. Pat. Nos. 2,783,609; 3,097,412; 3,577,614; 3,545,057; 3,863,309; and the like.

The texturing jet used in the present invention is operated at sufficient gaseous pressure so as to separate the individual filaments in the yarn from each other, convolute and whirl said yarns about and, due to the overfeed, slackness of the filaments and the torque liveliness of the yarn and individual filaments cause the individual filaments to twist upon themselves, thereby forming kinks in the individual filaments in the yarn.

The gaseous pressure at which such jets are operated varies with the individual jet and the design thereof. With a commercially available jet, such as that described in U.S. Pat. No. 3,097,412, pressures of 70 to 110 p.s.i.g. at 2 to 5 SCFM give good results. However, the gaseous pressure that is used is that which is sufficient to separate the individual filaments in the jet and permit the turbulent gas and torsional twist action of the filaments of the yarn to form said kinks. Said gaseous pressures and overfeed are also sufficient so that an average, over a one meter length, of at least 5 kinks and/or twisted loops are formed per centimeter of yarn length. The exact number of kinks preferred for a given yarn will vary with aesthetics desired and that will at least partially depend on yarn total denier, denier per filament, inserted twist level, jet overfeed, jet gas pressure and efficiency, yarn throughput speed and the like. The process of the present invention appears to operate with a higher degree of jet efficiency than flat yarn texturing.

A kink, as used herein, is intended to designate a loop formed by an individual filament which is twisted back on itself due to the torque forces of the reversing helix twist running longitudinally along the length of the filament. The base of the loop formed by the filament completes a 360° turn such that the filament touches itself at the base of the loop to thereby close the loop. Often the base of the loop is further twisted on itself 0.2 to 4 times to give the appearance of a spiral column at the base of the loop. This is because the torsional forces in the yarn readily forms the kinks when the yarn is open in the relaxed state. Consequently, with a given jet, much higher linear yarn speeds can be utilized to effect the desired effect with the torque yarn of applicant's process than is required for flat yarn.

The yarn being withdrawn from the jet can be taken up on a package for use. However, it is preferred, particularly in the case of polyester and nylon yarns, that the yarn be further heat set to decay the residual yarn torque and to fix the kinks into the yarn. Heat setting is accomplished by passing the yarn from the jet through a second heater 23. The yarn is preferably still in the relaxed state when passed through the second heater but because of the reduction in length of the yarn by formation of the kinks in the jet, the degree of relaxation left in the yarn is on the order of about 5 to 30 percent. The exact amount of residual relaxation in the yarn is dependent upon the overfeed from draw roll 17, the amount of kinks formed in the yarn which, in part, is dependent upon the inserted twist level, the fiber denier, the total yarn denier and the like factors.

The second heater 23 is operated at a temperature which, contrary to conventional false twist texturing, is preferably higher than heating means 19. Such second heater 23 is preferably a hot air oven operated in the range of about 180° to 300° centigrade. The particular temperature utilized is dependent upon the twist setting temperature, the amount of torque decay desired, the degree of relaxation desired, the heat setting time, the degree of tension stability desired and other related factors. Longer heat setting times and higher temperatures will result in a greater degree of set and greater decay of residual torque. Of even greater importance, a high second heater temperature tends to embrittal the projecting kinks while the relatively short resident time and fiber bundle insulates the core of the yarn from such embrittlement. On subsequent processing, the embrittled kinks tend to break, thus leaving projecting hairy fibrils.

While the yarns produced in the process described have been heretofore directed solely to the continuous processing of flat yarn through false twist texturing and thence jet texturing, it will be recognized by those skilled in the art that the process described can be divided into a series of individual yarn treatments to accomplish the same processing steps. Thus, for instance, one could start with torgue lively false twist textured yarn and subject it to the jet treatment described. In the same manner, the process of the present invention can be operated in conjunction with a flat yarn which is not first false twist textured. Under such conditions, a flat yarn 12 can be fed from another package source 11 to the jet texturing device 22 along with the false twist textured yarn such that the flat yarn is utilized as a core or effect material for the resulting textured yarn. Under such conditions, it may often be desirable to feed flat yarn 12 under a higher tension than the false twist textured yarn to the texturing jet wherein the tension is controlled by feed roll 14. Such a flat core yarn may be desirable, particularly when weaker false twist textured filaments are utilized such as when acetate or triacetate are utilized as the bulking or kink-forming yarn coupled with a stronger yarn such as polyester or nylon which forms the core. Using such conditions, it may be desirable to omit the second heater means because the core yarn can hold the kinked fiber members in position.

As has been pointed out above, the yarn being treated is torque lively and subsequent to the jet entanglement of the yarn, it is preferred to decay the torque. Prior to decaying the torque, it is preferred that the yarn have a torque liveliness in the range of 50 to 130 as measured on the draw roll, i.e., the roll prior to feeding the yarn to the jet, and more preferably in the range of 90 to 120. The decayed torque of the yarn after jet entanglement and heat setting is preferably in the range of 0 to 20 and more preferably 8 to 12.

The torque ranges noted are measured by a simple torque determination which involves counting the number of turns a specific length of yarn will twist when allowed to relax. The test is conducted by positioning a 36-inch length of yarn to be tested horizontally along a measuring stick and securing both ends of the yarn by clamps in a crimp extended fashion. The yarn is tensioned sufficiently to prohibit kinking without stretching the yarn, and clamped into position. A large paper clip weighing 1.565 ± 0.005 grams is attached to the center of the claimped yarn. One end of the clamped yarn is moved to meet the other end of the clamped yarn over an interval of two seconds, thereby permitting the yarn to twist and kink. The point at which the clip stops twisting is then noted and the yarn is then re-extended to detwist with the detwisting revolutions of the paper clip being counted to the nearest quarter turn. At least three test lengths of yarn are sampled and the average to the nearest 0.1 turn is recorded as the yarn torque.

Figure 2:
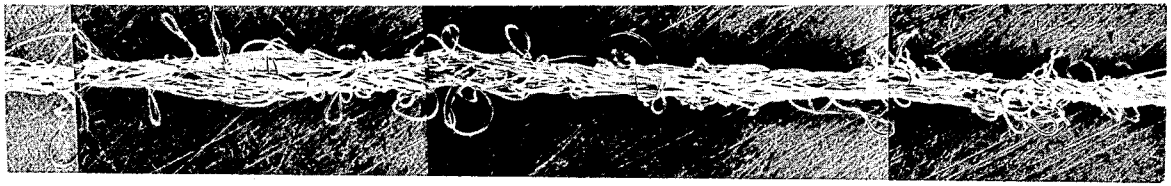
FIGS. 2 and 3 are microphotographs of yarns produced in accordance with the present invention.

FIG. 2 of the drawings represents a typical example of yarn produced in accordance with the present invention. The yarn of FIG. 2 is a 20 magnification composit microphotograph. The length of the composit shown in FIG. 2 is equal to 1 centimeter of yarn. Examination of FIG. 2 will reveal numerous kinks as described herein wherein individual filaments of yarn loop and twist upon themselves such that more than 5 kinks per centimeter exist in the yarn. As can be seen in the photograph, the actual number of kinks in the yarn is substantially in excess of 5, and consequently the preferred range is at least 5 to about 200 or more kinks per centimeter, more preferably at least 5 to 100 kinks per centimeter.

Figure 3:
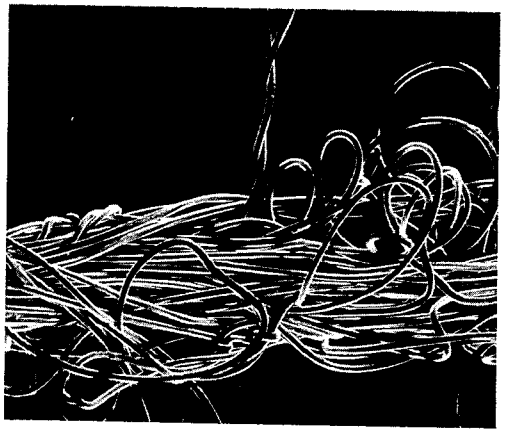

FIG. 3 is another microphotograph of a segment of yarn of the present invention at 40 magnification. The detailed kinking and entanglement of the yarn is clearly visible and illustrated by several different kinks. The kinks shown span the typical range of twisting of individual filaments upon themselves at the base of the kink from several revolutions to less than a full revolution as has been set forth herein.

The invention will be more specifically described by reference to the following examples which describe certain preferred embodiments and are not intended as limiting the invention.

EXAMPLE I

Yarn was made in accordance with the present invention utilizing an apparatus as set up in accordance with FIG. 1. Polyethylene terephthalate drawn yarn of 160 denier 66 filament round cross-section was fed at a rate of 501 feet per minute (f.p.m.) to a twisting means wherein 51 twists per inch (t.p.i.) were inserted into the yarn utilizing a primary heater temperature of 240° centigrade. Yarn was taken up at the draw roll at 506 f.p.m. and fed to an air jet made in accordance with U.S. Pat. No. 3,097,412. The yarn was overfed to the jet at 35.4 percent and the jet operated at an air pressure of 95 p.s.i.g. and a flow rate of 4.3 standard cubic feet per minute (s.c.f.m.). Yarn exiting from the jet was passed through a secondary hot air heater operated at 230° centigrade. The overall draw ratio for the yarn was 1. The drawn denier per filament was 2.4.

The resulting yarn was that in accordance with FIG. 2, having more than five kinks per centimeter and was tension stable. The yarn had low residual torque, an elongation of 29.1 percent and a tenacity of 2.93 grams per denier. This yarn, when constructed into fabrics, gave a wool-like hand and feel.

EXAMPLE II

Partially orientated 300/33 round cross-section polyethylene terephthalate yarn, having a spun elongation of 180 percent, a birefringencence of 0.028 and a crystallinity of 19 percent was processed in accordance with the present invention as set forth in FIG. 1. to form a 215/33 textured yarn. Utilizing a feed rate of 275 f.p.m., the yarn was passed across a hot plate operated at 240° centigrade through a twisting means wherein 30.2 t.p.i. were inserted in the yarn which twist backed up onto the hot plate where the twist was set. The draw roll was operated at 515 f.p.m. thus effecting a draw ratio of 1.87 across the hot plate. Untwisted torque lively yarn was passed from the twister to the air jet of Example I at an overfeed of 42.2 percent. The jet was operated at 93 p.s.i.g. and an air flow rate of 2.73 s.c.f.m. The yarn denier per filament (d.p.f.) at the draw roll was 4.7.

The resulting jet textured yarn was passed through a second heater operated at 230° centigrade wherein the yarn was set and the torque liveliness decayed. The resulting yarn was taken up on a package at 362 feet per minute. The yarn was similar to that shown in FIG. 2., having more than five kinks per centimeter, an elongation of 25.5 percent and a tenacity of 2.21 grams per denier.

EXAMPLE III

Another polyethylene terephthalate 134 denier 33 filament partially oriented yarn having similar crystallinity, birefringence and elongation as that of Example II was processed in accordance with the invention into 93 denier 33 filament round cross-section yarn of the present invention. The feed roll was operated at 295 f.p.m., passing the yarn across a hot plate at 240° centigrade through a twisting means wherein 50 t.p.i. was inserted into yarn and backed onto the hot plate where it was heat set. The draw roll was operated at 505 f.p.m. thus effecting a 1.71 draw ratio across the hot plate. The yarn on the draw roll had a 2.37 d.p.f.

The air texturing jet of Example I was utilized at an air pressure of 60 p.s.i.g. and an air flow of 2.1 s.c.f.m., using a yarn overfeed of 38.7 percent to the jet. Yarn exiting from the jet was passed through a second heater at 230° centigrade and taken upon a package at 364 feet per minute. The resulting yarn was similar to that of FIG. 2 having more than 5 kinks per centimeter, an elongation of 26.18 and a tenacity of 2.35 grams per denier.

EXAMPLE IV 150 denier 30 filament round cross-section textured polyethylene terephthalate yarn was produced in accordance with the present invention as shown in FIG. 1, utilizing 199 denier 30 filament partially orientated feedstock. The yarn was fed at a rate of 295 f.p.m. across a hot plate operated at 240° centigrade and through a twister wherein 30.8 t.p.i. was inserted into the yarn. The twist backed up onto the hot plate where it was set. The draw roll was operated at 505 f.p.m., effecting a draw ratio of 1.71 across the hot plate to give a drawn d.p.f. of 3.9 as measured on the draw roll. The resulting torque lively yarn was passed to the jet of Example I at a 38.3 percent overfeed. The jet was operated at 80 p.s.i.g. and an air flow rate of 3.3 s.c.f.m. Yarn from the texturing jet was then passed through a second heater at 230° centigrade to decay the torque and stabilize the yarn. The resulting yarn was similar to that of FIG. 2 having more than five kinks per inch, an elongation of 32.2 percent, and a tenacity of 2.56 grams per denier. The resulting yarn was tension stable and had excellent weaving properties.

EXAMPLE IV

Yarn processing speeds were increased to determine the ability of the jet to operate the present invention at speeds much higher than such jet was capable of operating with flat yarns. Five different polyethylene terephthalate yarns were processed in accordance with the invention to produce 125/48 round cross-section, 154/48 round cross-section, 181/48 round cross-section, 214/48 round cross-section and 239/48 round cross-section textured yarns. The feed yarns were partially orientated yarns having a birefringence of 0.028, a spun elongation of 180 percent and a crystallinity of 19 percent. The process was operated in the manner of Example II with the feedroll running at 572 f.p.m., the twisting means operated to insert 32 t.p.i., which twist was heat set on a hot plate operated at 230° centigrade. The drawroll was operate at 1000 f.p.m. thereby effecting a draw ratio of 1.75 across the hot plate. The resulting yarn was fed to the jet of Example I at an overfeed of 33.7 percent, an air pressure of 90 p.s.i.g. and a flow rate of 3.1 s.c.f.m. Yarn from the jet was passed through a second heater operated at 270° centigrade and then taken up on a package at 767 f.p.m. The resulting yarn was found to have processed very well at the high speeds, producing a yarn similar to that of FIG. 2, having more than five kinks per centimeter. The jet used performed adequately at the noted speeds which were substantially faster than the jets capabilities with flat yarn.

EXAMPLE VI

Hexalobal cross-section yarn of 200 denier 36 filament polyethylene terephthalate was produced in accordance with the present invention, utilizing 290/36 partially orientated feedstock. The yarn was processed in accordance with FIG. 1 using a feedroll speed of 561 f.p.m. and passed through a twister which inserted 32 t.p.i. The twist was set on a hot plate operated at 230° centigrade. The drawroll was operated at 1000 f.p.m. thereby effecting a draw ratio of 1.71 to produce 4.5 d.p.f. yarn as measured on the drawroll. The resulting torque lively yarn was fed to the jet of Example I at a 33.9 percent overfeed. The jet was operated at 90 p.s.i.g. and an air flow of 3.25 s.c.f.m. Yarn from the jet was passed through a second heater operated at a temperature of 270° centigrade and taken up on a package at 801 f.p.m. The resulting yarn was similar to that of FIG. 2 having more than five kinks per centimeter and exhibiting a wool-like hand when made into fabric.

EXAMPLE VII

In the manner of Example VI, 200/48 hexalobal cross-section polyethylene terephthalate textured yarn was produced utilizing 290/48 hexalobal partially orientated polyethylene terephthalate feedstock. Similar feed rates and draw ratios were utilized using similar jet pressures and air flows. The difference, however, was that a lower hot plate twist setting temperature was utilized, that is 200° centigrade. The resulting yarn was found to have similar desirable characteristics as the yarn of Example VI, it being illustrated that lower heat setting temperatures could effect correspondingly good results even at the high throughput speeds. It was further observed that a correspondingly better intermingling was obtained when compared to round cross-section yarns.

EXAMPLE VII

This example illustrates the utilization of undrawn feedstock of 444/66 round cross-section polyethylene terephthalate to produce a 216 denier 66 filament textured yarn. Undrawn yarn was processed in accordance with FIG. 1, utilizing a feedroll speed of 391 f.p.m., passing the yarn across a heat plate operated at 230° centigrade and through a twister wherein 32 t.p.i. was inserted into the yarn. The inserted twist was backed onto the hot plate and set. The drawroll was operated at 1000 f.p.m., thereby effecting a draw ratio of 2.55 across the hot plate to produce 2.5 d.p.f. yarn as measured on the drawroll. The resulting torque lively yarn was overfed 33.7 percent. to the jet of Example 1 which was operated at an air pressure of 90 p.s.i.g. and a flow rate of 3.3 s.c.f.m. Yarn exiting from the jet was passed through a second heater operated at 270° centigrade and taken up on a package at 774 f.p.m. The resulting yarn was tension stable and similar to the yarn of FIG. 2.

EXAMPLE IX

A particularly desirable yarn which was suitable for the most popular fabric constructions was produced from 289/66 round cross-section polyethylene terephthalate partially orientated feedstock to produce a 200/66 textured yarn. The partially orientated feed stock was processed in accordance with FIG. 1 by feeding the yarn at the rate of 561 f.p.m. across a hot plate to a twister wherein 32 t.p.i. were inserted into the yarn then twisted back onto the hot plate which was 200° centigrade wherein the twist was set. The draw roll was operated at 1000 f.p.m., thereby effecting a draw ratio of 1.78 to produce 2.5 d.p.f. yarn at the drawroll. The resulting torque lively yarn was fed to the jet of Example I at an overfeed of 33.1 percent. The jet was operated at 90 p.s.i.g. and an air flow of 3.3 s.c.f.m. Yarn from the jet was passed through a second heater operated at a temperature of 270° centigrade and taken up on a package at 808 f.p.m. The resulting product was similar to that of FIG. 2, having more than five kinks per centimeter and was tension stable. When woven or knitted into fabric, the product exhibited wool-like characteristics.

EXAMPLE X

In the manner of Example IX, the process was repeated, utilizing a second fully drawn flat yarn of 160/66 polyethylene terephthalate which is fed along with the torque lively yarn to the drawroll and passed to the jet for texturing under the jet conditions of Example IX. The resulting yarn was then heat set in accordance with Example IX and taken up on the package. The resulting yarn was very bulky and was extremely tension stable.

When this process was repeated eliminating the second heater, a correspondingly bulky yarn was produced but the bulk could be pulled out under heavy tension.

EXAMPLE XI

The process of Example IX was repeated in all respect with the exception that the second heater was by-passed and the yarn directly packaged after withdrawal from the air jet. The resulting product was similar to that of FIG. 2 but did not have the tention stability as the yarn of Example IX.

While the examples have illustrated primarily the utilization of the present process with polyethylene terephthalate yarns, it is recognized that the substitution of other thermoplastic false-twist texturable yarns can also be used with correspondingly good results. Such yarns can be used in combination with polyethylene terephthalate or other combinations as set forth herein.

While the invention has been described more particularly with reference to the preferred embodiments, it is recognized that various changes can be made without departing from the spirit of the invention. Consequently, it is intended to claim the invention broadly, being limited only by the appended claims.

What is claimed is:

1. A continuous filament spun-like yarn comprising a heat set stabilized multifilament synthetic yarn wherein individual filaments are longitudinally in a helical configuration with periodic reversals of extended helix direction along their length, said individual filaments additionally having torque induced kinks and twisted loops in random distribution along the length of said yarn, said yarn being held together as an integral bundle by the intermingling of the respective individual filaments.

2. The yarn of claim 1 wherein the synthetic filaments are selected from the group consisting of polyester, polyamide, cellulose acetate, cellulose triacetate, acrylic, modacrylic and mixtures thereof.

3. The yarn of claim 1 comprised of a polyamide.

4. The yarn of claim 1 comprised of polyethylene terephthalate.

5. The yarn of claim 1 wherein a kink is comprised of a torque induced loop of reversing helix twist wherein a filament completes a 360° turn and touches itself at the base of the loop.

6. The yarn of claim 5 wherein said yarn has an average of at least 5 kinks per centimeter of length when measured over a one meter yarn length.

7. The yarn of claim 5 wherein said yarn kinks are twisted at the base thereof 0.2 to 4 turns.

8. The yarn of claim 1 having substantially no real twist.

9. The yarn of claim 1 containing a core portion of substantially untextured continuous filaments.

10. The yarn of claim 1 wherein the individual filaments have a multilobal cross-section.

11. The yarn of claim 10 wherein the multilobal cross-section is hexalobal.

* * * * *

UNITED STATES PATENT OFFICE

CERTIFICATE OF CORRECTION

Patent No. 4,060,970 Dated December 6, 1977

Inventor(s) JAMES RICHARD TALBOT

It is certified that error appears in the above-identified patent and that said Letters Patent are hereby corrected as shown below:

Column 1, line 22, change "confort" to read -- comfort --.

Column 4, line 21, after the word "measurement" insert the word -- methods --.

Column 7, line 23, correct the word "claimped" to read -- clamped --.

Column 7, line 35, correct the word "composit" to read -- composite --.

Column 7, line 36, correct the word "composit" to read -- composite --.

Column 9, line 19, change the caption "EXAMPLE IV" to read -- EXAMPLE V --.

Column 9, line 36, change "operate" to read -- operated --.

Column 10, line 19, change the caption "EXAMPLE VII" to read -- EXAMPLE VIII --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*